US006524088B2

(12) United States Patent
Kasai et al.

(10) Patent No.: US 6,524,088 B2
(45) Date of Patent: Feb. 25, 2003

(54) GEAR PUMP HAVING A BEARING WITH A TEMPERATURE ADJUSTING MEDIUM PASSAGE

(75) Inventors: Shigehiro Kasai, Takasago (JP); Shoji Yoshimura, Takasago (JP); Nobuki Nagami, Takasago (JP); Kazuo Iritani, Takasago (JP); Katsunori Takahashi, Takasago (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/984,999

(22) Filed: Nov. 1, 2001

(65) Prior Publication Data

US 2002/0051720 A1 May 2, 2002

(30) Foreign Application Priority Data

Nov. 2, 2000 (JP) ..... 2000-336650
Nov. 2, 2000 (JP) ..... 2000-336651

(51) Int. Cl.[7] ..... F04C 2/18; F04C 15/00

(52) U.S. Cl. ..... 418/83; 418/206.3; 418/206.7; 384/321; 384/900

(58) Field of Search ..... 418/83, 84, 206.3, 418/206.7; 384/321, 900

(56) References Cited

U.S. PATENT DOCUMENTS 3,976,405 A * 8/1976 Geiger et al. ..... 418/206.7
5,292,237 A 3/1994 Orimo et al. ..... 418/94
5,924,854 A 7/1999 Blume et al. ..... 418/83

FOREIGN PATENT DOCUMENTS

JP 10-141247 5/1998

* cited by examiner

*Primary Examiner*—John J. Vrablik
(74) *Attorney, Agent, or Firm*—Oblon, Spivak, McClelland, Maier & Neustadt, P.C.

(57) ABSTRACT

To provide a gear pump for carrying high viscous liquid, which keeps a bearing in a free state and enhances reliability relative to a leakage of cooling medium and a leakage of molten resins. The gear pump in which a pair of gear rotors 2 are supported on a body 1 of the gear pump through a bearing 6, a cover for preventing the bearing 6 from being slipped out is secured to the body 1, and a temperature adjusting medium passage 20 is formed in the bearing 6, wherein an inlet pipe 28 and an outlet pipe 29 to the temperature adjusting medium passage 20 are connected to the axial outer end of the bearing 6, an intermediate plate 10 is interposed between the axial outer end of the bearing 6 and the cover 11, the intermediate plate 10 being provided with an insert hole 31 for the inlet pipe 28 and the outlet pipe 29, the cover 11 being provided with a guide portion 32 having the inlet pipe 28 and the outlet pipe 29 loosely fitted therein to guide them to outside. Further, at least a part of the inlet pipe 28 and the outlet pipe 29 is formed from a flexible member.

18 Claims, 10 Drawing Sheets

GEAR PUMP HAVING A BEARING WITH A TEMPERATURE ADJUSTING MEDIUM PASSAGE

BACKGROUND OF THE INVENTION

1. Field of the Invention

The present invention relates to a gear pump for carrying high viscous fluid such as molten resins.

2. Description of the Related Art

For example, the gear pump for carrying molten resins has a pair of gear rotors, that being supported rotatably the pump body through a bearing. The bearing is a slide bearing, which is of a self-lubricating type in which a part of the molten resins to be carried as bearing lubricating agent.

In the gear pump of this kind, it is important to increase the production amount (carrying amount), and methods thereof include a method for increasing the number of revolutions and a method for widening the tooth width. However, in any of these methods, the burden on the bearing increases to lead to high possibility of baking, which makes difficult to increase the production amount.

That is, when the number of revolutions is increased, the shearing speed is high, which results in high heat generation of resins and lowering bearing support ability. Further, when the tooth width is widened, the load increases, and the bearing support ability lowers.

In view of the above, in the gear pump of this kind, it is most effective for enhancing the bearing ability to lower a temperature of the molten resins as lubricant to raise the viscosity of resins.

Methods for cooling the lubricant (molten resins) include a method for cooling a rotor shaft (for example, see U.S. Pat. No. 5,292,237), a method for cooling a bearing (for example, see U.S. Pat. No. 5,924,854), or a method for cooling a bearing (for example, see Japanese Patent Application Laid-Open No. Hei 10-141247 Publication).

In the aforementioned U.S. Pat. No. 5,924,854, a bearing and a viscous seal are integrated to thereby prevent leakage of a temperature adjusting medium and that of resins.

However, this poses a problem that because of the construction in which the bearing is secured to the body, an unreasonable load is applied to the bearing.

That is, since the bearing is pressed in a different direction depending on the operating conditions such as the discharge pressure or the number of revolutions, it is preferable that the bearing be mounted in the free state with respect to the body. However, when it is secured to the body as in the prior art described previously, there occurs a problem that the unreasonable load is applied to the bearing.

Especially, in case of an arrangement in which a bearing is cooled, a clearance present between the bearing and the body is further enlarged by cooling the bearing, which makes the problem further serious.

The aforementioned integral type has a problem that manufacturing is difficult and the cost increases.

On the other hand, in the disclosure of Japanese Patent Application Laid-Open No. Hei 10-141247 Publication, the bearing is constituted separately from the viscous seal, but there is a problem that the cooling medium leaks or assembling is difficult.

That is, an inlet passage or an outlet passage of cooling medium with respect to the bearing are provided on a cover (side plate) for securing the bearing, and a seal construction between the cover and the bearing is difficult.

It is therefore an object of the present invention to provide a gear pump for carrying high viscous liquid, which keeps a bearing free, and enhances reliability relative to leakage of cooling medium or leakage of molten resins.

SUMMARY OF THE INVENTION

For achieving the aforementioned object, the present invention employs the following constitutions.

According to the present invention, there is provided a gear pump comprising: a body; a bearing; a pair of gear rotors, said gear rotors being supported on said body through said bearing; a cover for preventing said bearing from being slipped out in the axial direction of said bearing, said cover being secured to said body; a temperature adjusting medium passage formed in said bearing; an inlet pipe provided on the axial outer end of said bearing, said inlet pipe being communicated with said temperature adjusting medium passage; an outlet pipe provided on the axial outer end of said bearing, said outlet pipe being communicated with said temperature adjusting medium passage; and an intermediate plate interposed between the axial outer end of said bearing and said cover, said intermediate plate being formed with a hole for inserting said input pipe and said outlet pipe therein, wherein said cover is provided with a guide portion having said inlet pipe and said outlet pipe loosely fitted therein to guide them to outside.

The provision of the intermediate plate, as described above, enables positive prevention of the leakage of temperature adjusting medium and the leakage of material to be carried. In addition, in place of inserting the inlet pipe and the outlet pipe into the cover, constitution of inserting them into the intermediate plate may be employed to thereby facilitate assembling.

In the gear pump according to the present invention, preferably, said bearing is held on said body in a non-secured state. By such a constitution as described, unreasonable load is not applied to the bearing.

In the gear pump according to the present invention, preferably, the pump is for carrying molten resins.

In the gear pump according to the present invention, preferably, constitution is employed in which a part of the carried material to be supplied as lubricant between said bearing and said gear rotor.

In the gear pump according to the present invention, constitution is employed in which said guide portion is depressed along the diametrical direction of said rotor on the intermediate plate side end of said cover.

In the gear pump according to the present invention, both end surfaces of said intermediate plate may comprise seal surfaces.

In the gear pump according to the present invention, both end surfaces of said intermediate plate may contact with said bearing and said cover through a seal member.

In the gear pump according to the present invention, said inlet pipe and said outlet pipe may be mounted on said bearing through watertight means.

In the gear pump according to the present invention, said intermediate plate may be integrated with a thrust plate provided in order to locate said bearing in an axial direction. Said thrust plate is provided separately from said bearing.

Further, in the gear pump according to the present invention, there are provided a viscous seal for preventing leakage of liquid form said gear rotor, said viscous seal being provided at an axial outer position of said bearing, and fastening means provided on said viscous seal, said fastening means raising mounting surface pressure of said intermediate plate and said cover.

Further, according to the present invention, there is provided a gear pump comprising: a body; a bearing; a pair of gear rotors, said gear rotors being supported on said body through said bearing; a cover for preventing said bearing from being slipped out in the axial direction of the bearing, said cover being secured to said body; temperature adjusting medium passage formed in said bearing; an inlet pipe provided on the axial outer end of said bearing, said inlet pipe being communicated with said temperature adjusting medium passage, at least a part of said inlet pipe being formed from a flexible member; and an outlet pipe provided on the axial outer end of said bearing, said outlet pipe being communicated with said temperature adjusting medium passage, at least a part of said outlet pipe being formed from a flexible member, wherein said cover is provided with a guide portion having said inlet pipe and said outlet pipe loosely fitted therein to guide them to outside.

By being constituted as described above, it is possible to realize a gear pump capable of preventing leakage of temperature adjusting medium and leakage of material to be carried positively, and facilitating assembling.

Further, in the gear pump according to the present invention, constitution can be employed in which the guide portion is provided in parallel with the shaft center of the gear rotor, and the diameter of the guide portion is larger than that of the inlet pipe and larger than that of the outlet pipe.

DESCRIPTION OF THE PREFERRED EMBODIMENTS

The embodiments of the present invention will be described hereinafter with reference to the drawings.

Figure 1:
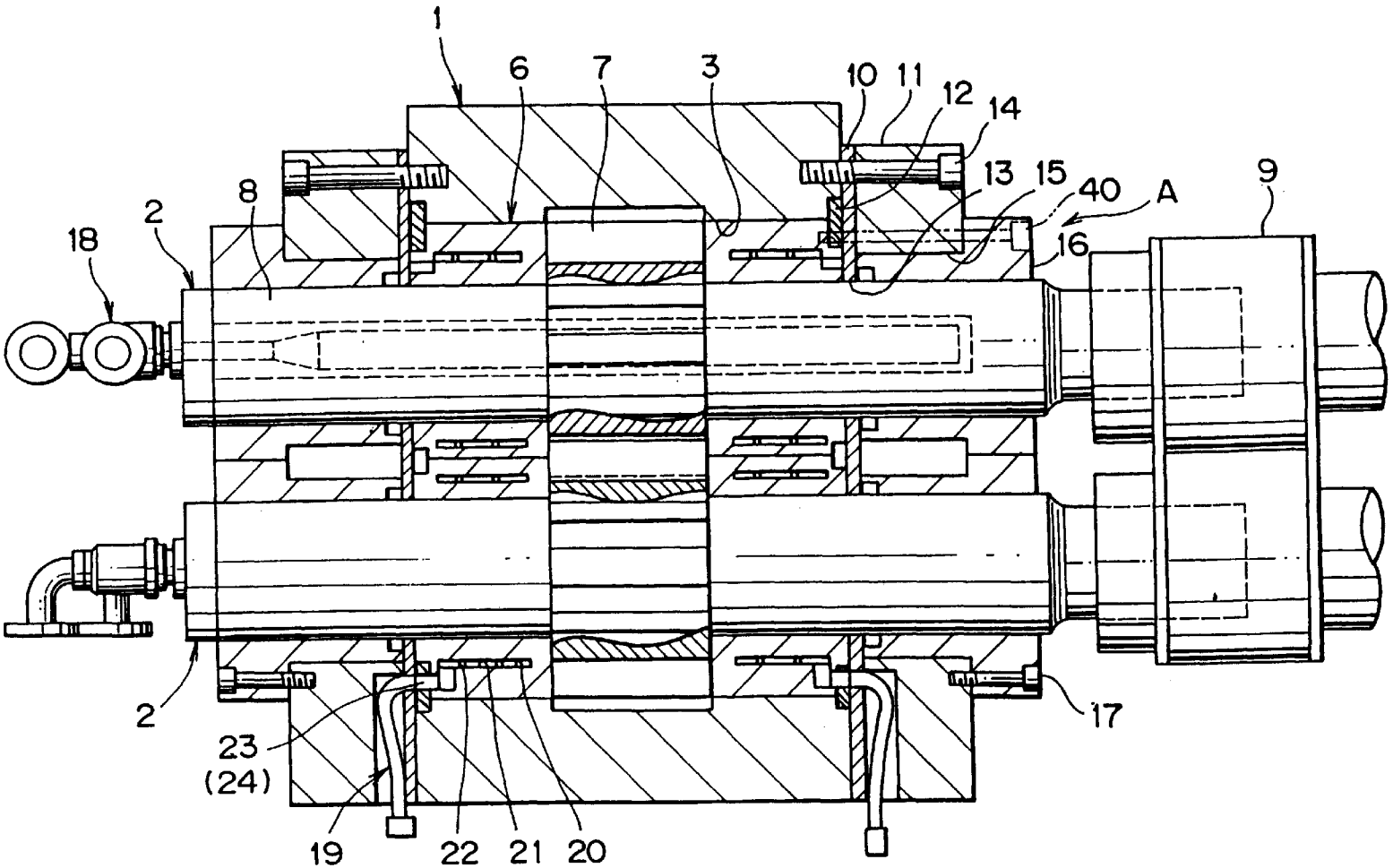
FIG. 1 is a sectional view of a gear pump showing an embodiment of the present invention, which is a sectional view taken on line I—I of FIG. 2.
Figure 2:
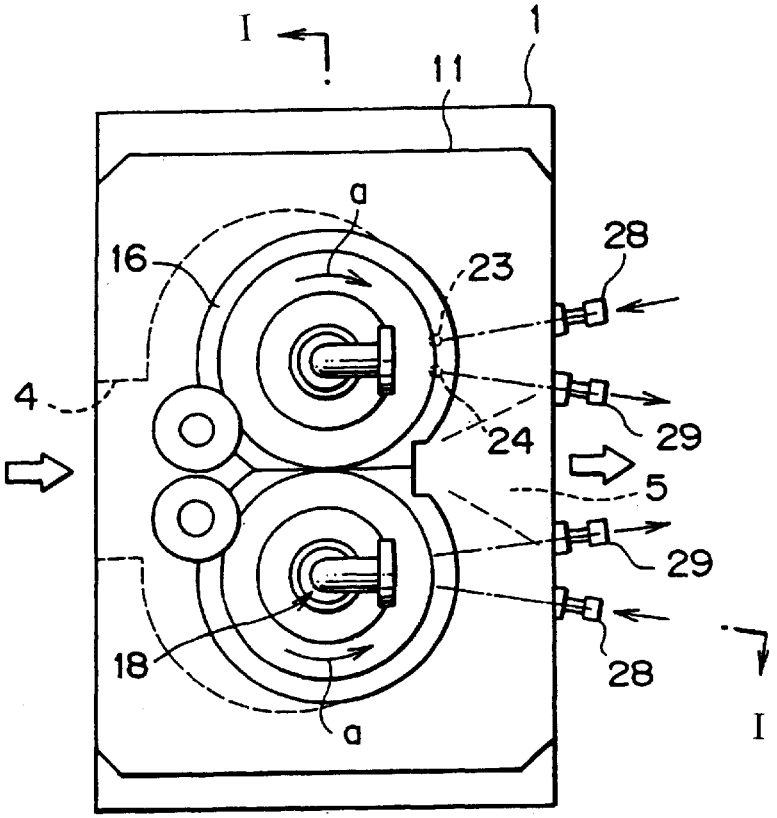
FIG. 2 is a side view taken from FIG. 1.

Shown in FIGS. 1 and 2 is a gear pump for carrying quantitative molten resins in a mixing granulating system. The gear pump has a pump body 1, and a pair of gear rotors 2 encased in the body 1.

The body is formed into a block form, within which a glasses-like rotor housing hole 3 is formed, and a resin inlet 4 and an outlet 5 are formed in an axial central portion of the rotor housing hole 3 and on both sides in a diametrical direction. The pair of gear rotors 2, 2 are rotatably housed in the rotor housing hole 3 through a bearing 6.

The rotor 2 comprises a gear part 7 and shaft parts 8 formed on both sides of the gear part 7. The gear part 7 of the pair of rotors 2, 2 is always meshed, and the shaft part 8 is supported on the bearing 6.

One end of the shaft part 8 of the rotor 2 is connected to a drive device (not shown) through a coupling 9, the rotor 2 being rotated and driven in a direction of arrow a, and molten resins are carried from the resin inlet 4 to the outlet 5 by the gear part 7.

The bearing 6 is fitted in the rotor housing hole 3 in a non-secured state. The bearing 6 is formed cylindrically, an inner circumferential surface thereof being a slide bearing surface, and a part of an outer circumferential surface being cut and formed to be a flat surface. The bearing 6 is housed in the glasses-like rotor housing hole 3, in which state the flat surfaces come in contact with each other to prevent rotation thereof. It is noted that the outside diameter of the bearing 6 is about 600 mm in case of a large one.

The axial inner end of the bearing 6 can be placed in contact with the side of the gear part 7 of the rotor 2. The axial outer end of the bearing 6 is substantially flush with the end of the body 1.

The bearing 6 is prevented from being slipped out outward in an axial direction by a cover 11 mounted on the end of the body through an intermediate plate 10. And, a small diameter shoulder is formed on the outer circumferential portion of the axial outer end of the bearing 6, and a ring-like thrust plate 12 is fitted in the shoulder.

It is noted that the thrust plate 12 may be integrated with the bearing 6.

The intermediate plate 10 is formed from a single plate, which has a pair of through-holes 13 for loosely fitting the shaft part 8 of the gear rotor 2. The outer shape of the intermediate plate 10 has size for covering the whole end of the bearing 6 and a part of the end of the body 1, and the thickness of the intermediate plate 10 is about 60 mm.

The cover 11 is a weight member formed from a block, whose outer shape is substantially the same as the intermediate plate 10, and whose thickness is about 200 mm. The cover 11 is secured to the end of the body 1 through a bolt 14.

The cover 11 is provided with a pair of seal member insert holes 15 which are concentric with the shaft center of the gear rotor 2, and a viscous seal 16 is fitted in the hole 15.

The viscous seal 16 is formed into a cylindrical body with a flange, whose outer circumferential surface is partly formed with a flat surface, and a pair of viscous seals 16 have flat surfaces placed in contact with each other, similar to the bearing 6. The flange of the viscous seal 16 is secured to the cover 11 through a bolt 17. The axial inner end of the viscous seal 16 faces to the outer end of the intermediate plate 10. The inner circumferential surface of the viscous seal 16 and the shaft part 8 of the gear rotor 2 prevent the molten resin from flowing out by means of a labyrinth seal.

A rotor temperature adjusting device 18 is provided on the shaft center portion of the rotor 2, and a control device (not shown) for supplying temperature adjusting medium is connected to the adjusting device 18. Since their details are the same as those described in U.S. Pat. No. 5,292,237, reference is made thereto, and the detailed explanation thereof is omitted.

The bearing 6 is also provided with a bearing temperature adjusting device 19, and a control device (not shown) for supplying a temperature adjusting medium is connected to the adjusting device 19. The bearing temperature adjusting device 19 has a temperature adjusting medium passage 20 formed internally of the bearing 6. The temperature adjusting medium passage 20 comprises an annular space 21 formed internally of the bearing 6, and a partitioning wall 22 provided in the annular space 21.

Figure 3:
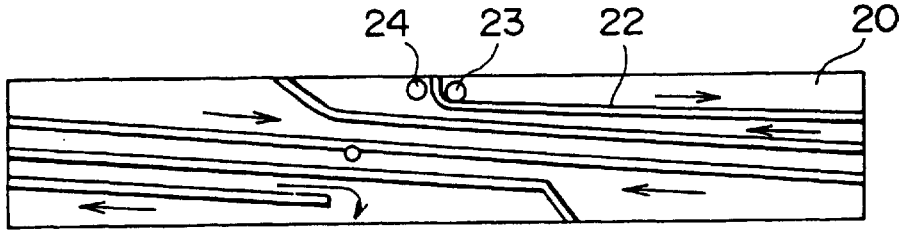
FIG. 3 is a circumferential developed view of a temperature adjusting medium passage.

FIG. 3 is a circumferential developed view of the temperature adjusting medium passage 20, and the partitioning wall 22 is provided spirally. The annular space 21 is formed with the temperature adjusting medium passage 20 comprising two spiral grooves, and a temperature adjusting medium inlet 23 is formed in the end of one of the grooves, and a temperature adjusting medium outlet 24 is formed in the end of the other.

Figure 4:
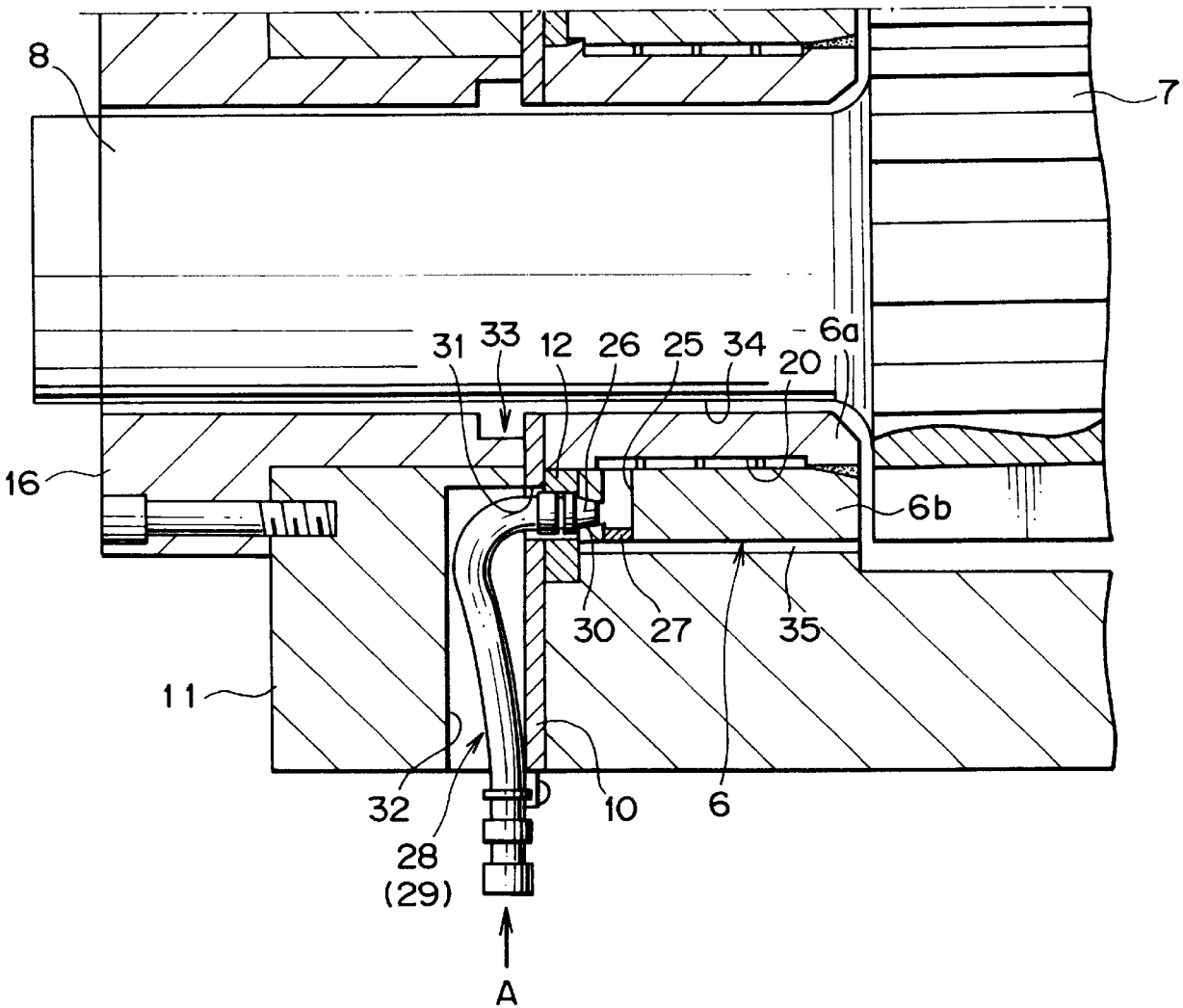
FIG. 4 is an enlarged sectional view of a main part of an embodiment of the present invention.

As shown in FIG. 4, the bearing 6 is constituted by an inner circumferential member 6*a* and an outer circumferential member 6*b* connected integrally, and the temperature adjusting medium passage 20 is formed in a boundary of the inner circumferential member 6*a* and the outer circumferential member 6*b*.

In this embodiment, an annular recess for forming the annular space 21 is formed in the outer circumferential surface of the inner circumferential member 6*a*, and the spiral partitioning wall 22 shown in FIG. 3 is formed integrally within the annular recess. And, the outer circumferential member 6*b* is fitted in the inner circumferential member 6*a* to form an integral configuration. This integral configuration is done welding or welding after shrinkage fitting.

In the integrated state as described, the outer circumferential surface of the partitioning wall 22 is in contact with the inner circumferential surface of the outer circumferential member 6*b*.

The partitioning wall 22 is formed over the inner and outer circumferential surfaces of the annular space 21 as described above whereby the partitioning wall 22 functions as a strengthening member. Accordingly, even if the annular space 21 is made larger in order to raise the cooling effect, the lowering of the bearing strength can be strengthened.

In the present invention, alternatively, the annular recess may be provided in the inner circumferential surface of the outer circumferential member 6*b* to provide the partitioning wall 22. Further, the temperature adjusting medium passage 20 may not be limited to the double spiral groove construction, but a groove construction by way of a combination of a circumferential partitioning wall and an axial partitioning wall may be employed. Furthermore, a conventional snaking hole described in U.S. Pat. No. 5,924,854 may be employed.

The temperature adjusting medium inlet 23 and outlet 24 are constituted by a diametrical hole 25 bored from the outer circumferential surface of the bearing 6 toward the annular space 21, and an axial hole 26 bored from the outer end surface of the bearing 6 toward the diametrical hole. The outer end of the diametrical hole 25 is sealed by a plug 27.

An inlet pipe 28 and an outlet pipe 29 are connected to the axial outer end of the bearing 6. Ends of the inlet pipe 28 and the outlet pipe 29 are connected to the axial hole 26 through water-tight means 30 so as to eliminate liquid leakage.

In the present embodiment, as the water-tight means 30, welding is employed, but it is not limited to welding. The liquid leakage may be prevented by screwing, and adhesive or sealing agent.

The thrust plate 12 and the intermediate plate 10 are provided with insert holes 31 in the form of extending-through concentric with the axial hole 26. The inlet pipe 28 or the outlet pipe 29 is inserted into the insert hole 31 in a loosely fitted manner.

Figure 5:
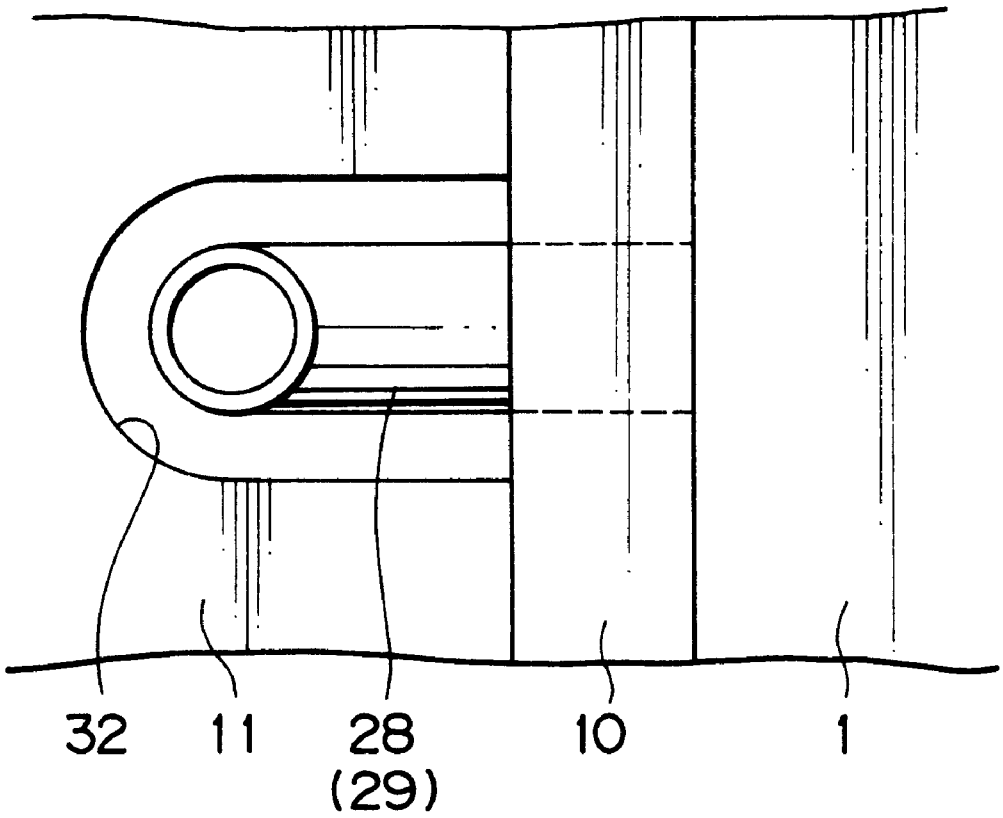
FIG. 5 is a view taken on arrow A of FIG. 4.

As shown in FIG. 5, the cover 11 is provided with a guide portion 32 for loosely fitting and guiding the inlet pipe 28 and the outlet pipe 29 to outside. The guide portion 32 is constituted by U-shaped recess that is recessed in the diametrical direction of the rotor on the intermediate plate side end of the cover 11.

At least a part of the inlet pipe 28 and the outlet pipe 29 is formed from a flexible tube to be bendable. Accordingly, the inlet pipe 28 and the outlet pipe 29 extending axially-outwardly from the end of the bearing 6 may be bended at right angle immediately after moving out of the insert hole 31 of the intermediate plate 10 and extended diametrically-outwardly along the guide portion 32 of the cover 11.

The inlet pipe 28 and the outlet pipe 29 projected diametrically-outwardly from the outer circumferential surface of the cover 11 are connected to a control device not shown. The temperature adjusting medium supplied to the inlet pipe 28 from the control device (not shown) flows into the spiral groove-like temperature adjusting medium passage 20 from the inlet 23 to adjust the temperature of the bearing 6, after which the medium passes from the outlet 24 to the outlet pipe 29, and then returns to the control device (not shown).

Temperature detecting means for detecting temperature of the bearing temperature adjusting medium is provide so as to detect outlet temperature of the temperature adjusting medium within the bearing 6. By the temperature detecting means, the temperature of the bearing temperature adjusting medium is controlled by the control device. Although not shown, the rotor temperature adjusting device 18 is also provide with temperature detecting means.

The gear pump is of the self-lubricating type in which a part of the molten resin to be carried is supplied as lubricating agent for the bearing 6 and the shaft part 8. As the self-lubricating construction, a well-known construction (for example, those described in publications listed with respect to prior art) may be employed, details of which are therefore omitted. The viscous seal 16 is to prevent leakage of molten resins to outside used in lubricating the bearing.

As shown in FIG. 4, the molten resin is supplied to a first clearance 34 between the outer circumferential surface of the shaft part 8 of the rotor 2 and the inner circumferential surface of the bearing 6 and used to lubricate the bearing, and also moves into a second clearance 35 between the outer circumferential surface of the bearing 6 and the inner circumferential surface of the rotor housing hole 3 of the body 1.

The molten resin in the first clearance 34 is prevented from leaking to outside from the shaft part 8 by the viscous seal 16, and is prevented from leaking to the insert hole 31 of the intermediate plate 10 and to the guide portion 32 of the cover 11 by the face contact between the intermediate plate 10 and the outer end of the bearing 6 and the face contact between the intermediate plate 10 and the inner end of the cover 11.

The resin in a portion indicated by numeral 33 is sealed by the outer end of the intermediate plate 10 and the inner end of the cover 11, and the resin in that portion is of the construction of returning to the suction side.

Further, the molten resin in the second clearance is prevented from leaking to the insert hole 31 of the intermediate plate 10 by the face contact between the inner end of the intermediate plate 10 and the outer end of the bearing 6 (in this embodiment, the end of the thrust plate 12).

That is, both ends of the intermediate plate 10 are constituted on the seal surface for preventing leakage of molten resin. That is, both ends of the intermediate plate 10 constitute a seal portion.

The operation of the gear pump for carrying molten resins constructed as described above will be explained hereinafter.

At the start of the gear pump, the heated medium is supplied from the control device (not shown) to the rotor temperature adjusting device 18 and the bearing temperature adjusting device 19 to preheat the rotor 2 and the bearing 6 thus preventing lubricating molten resins from cooling and solidifying. When preheating is finished and carrying molten resins is started, the temperature of the heated medium is lowered to switch to the cooling medium to cool the rotor 2 and the bearing 6, thus suppressing heat generation of the lubricating molten resins, suppressing lowering of viscosity under the high temperature to prevent the bearing support ability from lowering.

Alternatively, a cooling medium supply source and a heated medium supply source are individually provided, and supplied medium switching valve can be used to switch media. In this case, as the cooling medium out of the temperature adjusting media, oil, water, air or the like is used, and as the heated medium, oil can be mainly used. As other heated media, water, vapor or the like can be used.

Further, with respect to the control devices for the rotor temperature adjusting device and the bearing temperature adjusting device, a single device can be used in a combined manner. And the rotor temperature and the bearing temperature are controlled individually with the single device.

The leakage of these temperature adjusting media is prevented with high reliability since the bearing 6, and the inlet pipe 28 and the outlet pipe 29 are connected through the water-tight means 30.

Further, the leakage of the molten resins is prevented securely since the intermediate plate 10 is provided to make both ends thereof to serve as seal surface. In this case, unless the intermediate plate 10 is provided, it is difficult to prevent leakage from the second clearance 35 to the U-shaped guide portion 32 of the cover 11.

The provision of the intermediate plate 10 results in effect, in addition to raising the seal effect of molten resins, of facilitating assembling. That is, since the cover 11 is a weight member, it is very difficult to mount the cover on the end of the body 1 while inserting the inlet pipe 28 and the outlet pipe 29 projected from the end of the bearing 6. However, the intermediate plate 10 is provided whereby it is possible to employ the constitution in which the inlet pipe 28 and the outlet pipe 29 need not be inserted (the U-shaped guide portion 32), to facilitate assembling.

Figure 6:
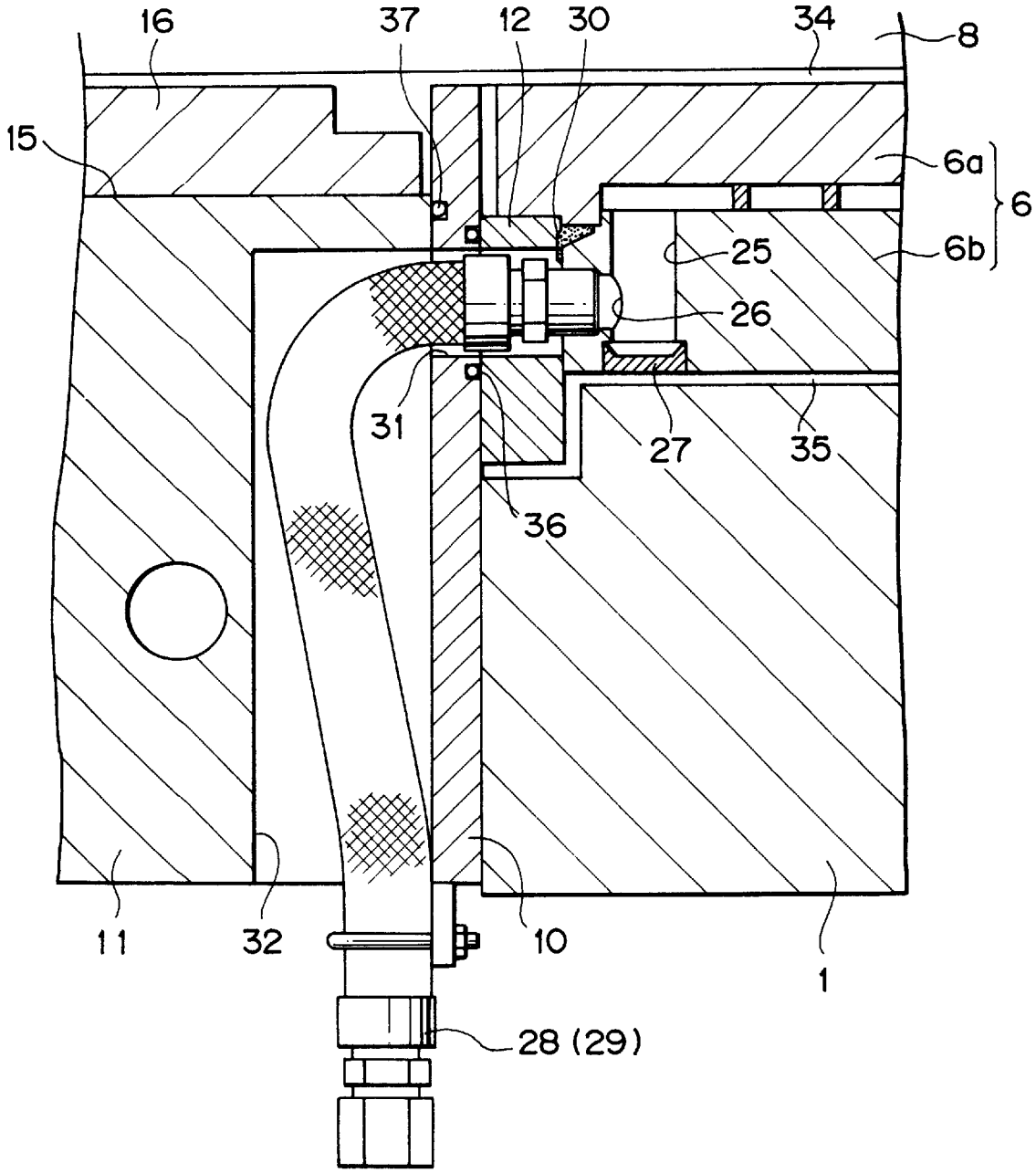
FIG. 6 is an enlarged sectional view of a main part showing a further embodiment of the present invention.

FIG. 6 shows another embodiment of the present invention, which is different from the embodiment described previously in that both ends themselves of the intermediate plate 10 are not made to serve as seal surfaces but the seal member is provided.

That is, O-ring fitting grooves are provided in the peripheral edges of the inlet pipe insert hole 31 and the outlet pipe insert hole 31 of the end on the bearing side of the intermediate plate 10, and a first O-ring 36 is fitted in the groove. Further, in the end on the cover side of the intermediate plate 10, an O-ring fitting groove concentric with the shaft center of the rotor is provided on the inner circumferential side with respect to the shaft center of the rotor of the insert hole 31, and a second O-ring 37 as a seal member is fitted in the groove.

Alternatively, one surface of the intermediate plate 10 is made to have a seal member 36 or a seal member 37 interposed, and one surface itself on the opposite side is made to serve as seal surface. Further, alternatively, a recess is provided on the intermediate plate side of the thrust plate 12 to fit the first O-ring 36 therein, and recess is provided on the intermediate plate side of the cover 11 to mount the second O-ring 37 thereon.

In the present invention, preferably, fastening means 40 (see FIG. 1) for pulling the bearing 6 in the direction of the cover 11 and holding the intermediate plate 10 with the great force so as to raise face pressure is provided on the viscous seal 16 in order to raise the seal effect of the intermediate plate 10. As the fastening means 40, preferably, separately from the arrangement that the viscous seal mounting bolt 17 is screwed into the cover 11, it is screwed into the bearing 6 (in the illustration, the thrust plate 12) extending through the cover 11 and the intermediate plate 10. By doing so, L/D (length to diameter) of the bolt 40 can be made sufficiently large, and the movement of the bearing can be secured with flexure of the bolt 40.

Alternatively, the bolt 17 may be screwed into the intermediate plate 10 extending through the cover 11 so as to increase face pressure on the outer end side of the intermediate plate 10. With the constitution as described, the movement of the bearing can be made more free as compared with the configuration of being screwed into the bearing 6.

Preferably, the direction of piping of the inlet pipe 28 or the outlet pipe 29 is made to be obliquely downward instead of horizontal direction. Piping is done obliquely downward as described above whereby even if leakage of resin should occur, the resin is not returned into the gear pump along the piping but is discharged outside.

Preferably, Ag plating is applied to the inner circumferential surface of the bearing 6. By applying plating as described, even if the peripheral speed of the rotor shaft part 8 is 0.5 m/s or more, the long service life of 10~20 years can be achieved together with the cooling construction of the bearing 6.

Figure 7:
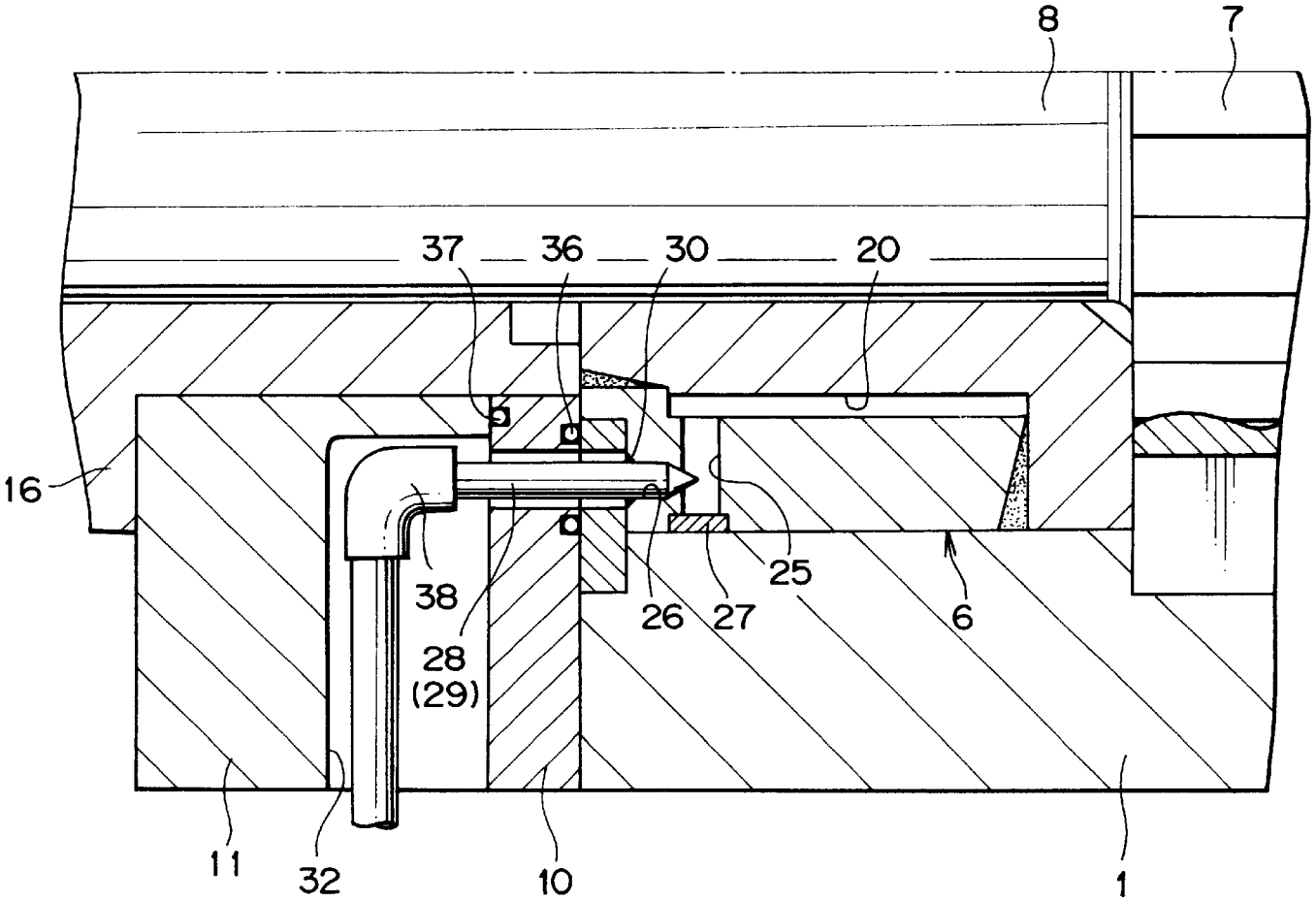
FIG. 7 is an enlarged sectional view of a main part showing another embodiment of the present invention.

FIG. 7 shows still another embodiment of the present invention, in which a part of the inlet pipe 28 or the outlet pipe 29 is not to be a flexible tube, but an elbow 38 is used to provide a rigid pipe bended at right angle. Other constitutions are the same as those described previously.

Figure 8:
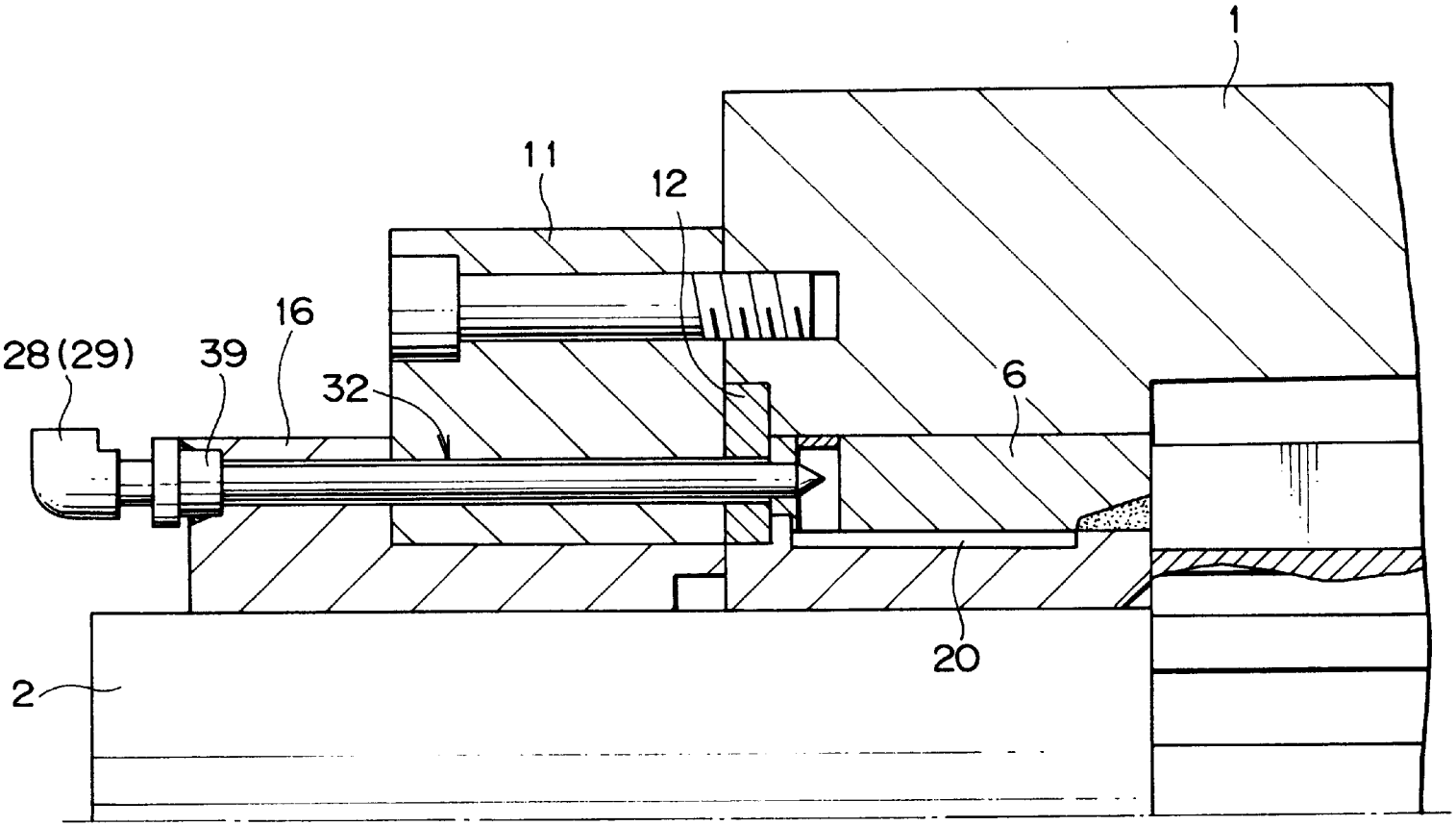
FIG. 8 is an enlarged sectional view of a main part showing still another embodiment of the present invention.

FIG. 8 shows another embodiment of the present invention, in which the thrust plate 12 is constituted separately from the bearing 6, and the intermediate plate 10 of the present invention is replaced by the thrust plate 12.

In this embodiment, the inlet pipe 28 and the outlet pipe 29 are extended in an axial direction, and the guide portion 32 for loosely inserting the inlet pipe 28 and the outlet pipe 29 into the cover 11 and the flange of the viscous seal 16 is provided in parallel with the shaft center of the rotor 2. The guide portion 32 is formed to be considerably larger than the inlet pipe 28 and the outlet pipe 29 to facilitate mounting of the cover 11. A bite pipe joint 39 is provided between the end of the guide portion 32 of the viscous seal 16 and the inlet pipe 28 and the outlet pipe 29 to prevent leakage of liquid.

Figure 9:
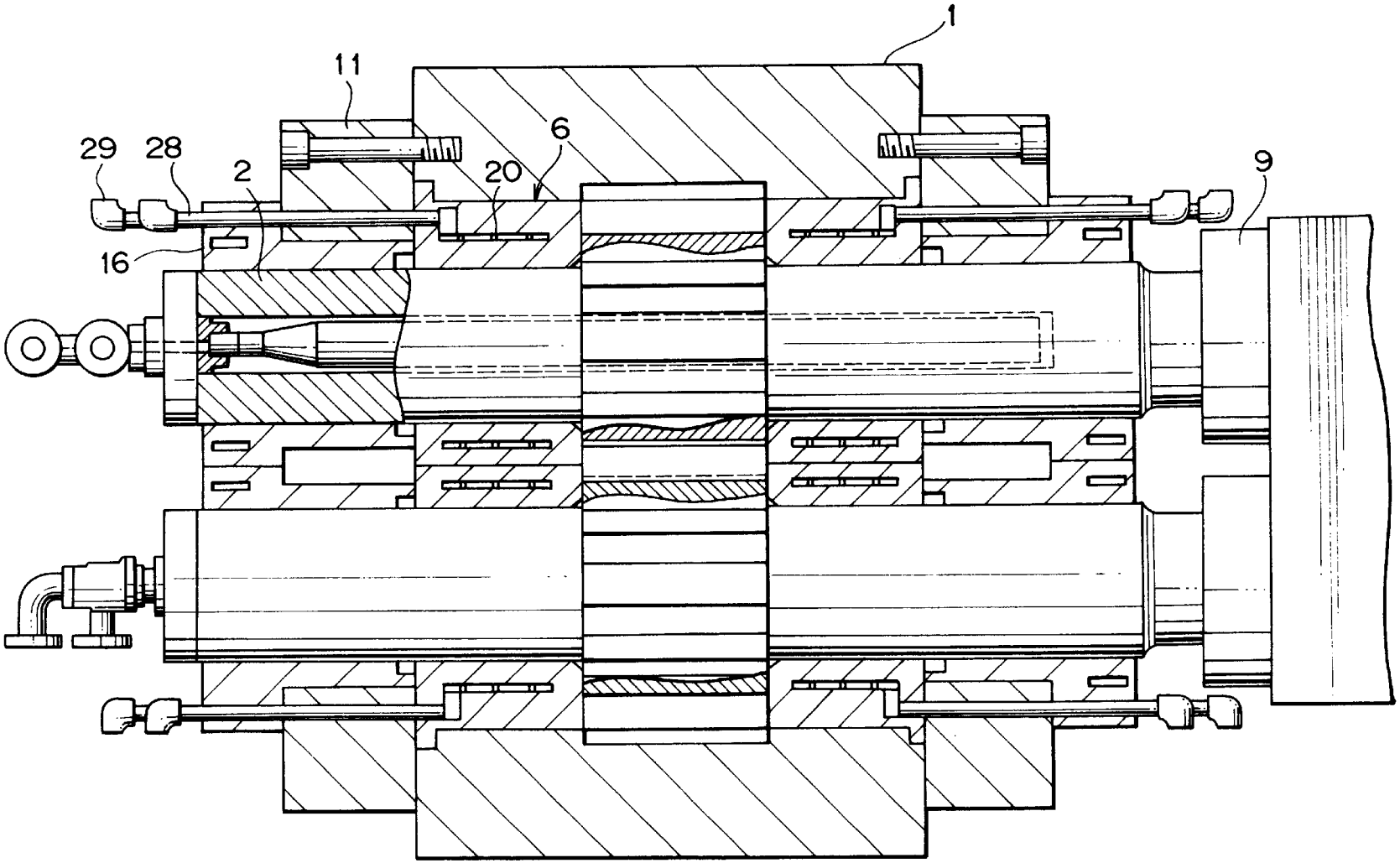
FIG. 9 is a sectional view of a gear pump showing a further embodiment of the present invention.

FIG. 9 shows still another embodiment of the present invention, in which shows a gear pump of the type having no intermediate plate 10. Members common to those described in the respective embodiments described previously are designated by the same reference numerals, description of which is omitted.

Figure 10:
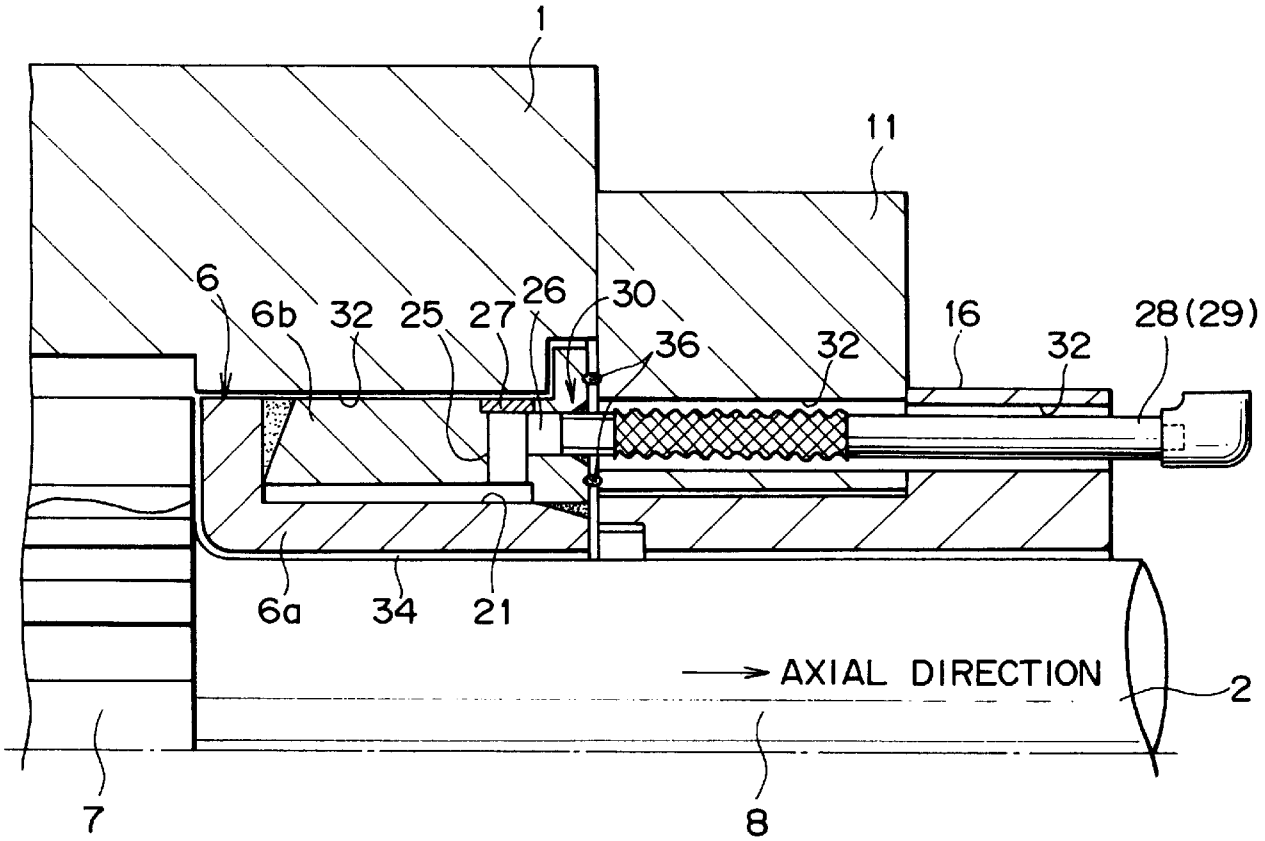
FIG. 10 is an enlarged sectional view of the main part of FIG. 9.

FIG. 10 shows the main part of FIG. 9. As shown, the guide portion 32 parallel with the axial direction is formed extending through the cover 1 and the flange of the viscous seal 16. The hole of the guide portion 32 is provided concentric with the axial hole 26, and is formed to be larger than the outside diameter of the inlet pipe 28 or the outlet pipe 29. In the inlet pipe 28 and the outlet pipe 29, a portion located at the guide portion 32 of the cover 11 is formed from a flexible tube.

The guide portion 32 is made larger in diameter, and a part of the pipe is made flexible whereby when the cover 11 is mounted, the inlet pipe 28 and the outlet pipe 29 are centered to the guide portion 32 to facilitate the insertion.

Between the outer end of the bearing 6 and the inner end of the cover 11, the first O-ring 36 as seal means is provided on the peripheral edge of the guide portion 32.

Leakage of molten resins in the first clearance 34 and the second clearance 35 to the guide portion 32 is prevented by the first O-ring 36 as the seal means.

Figure 11:
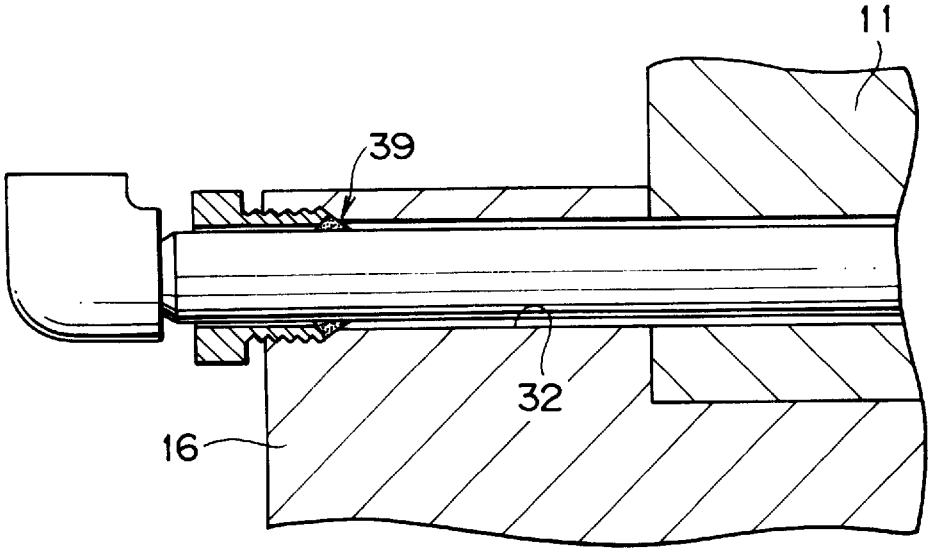
FIG. 11 is an enlarged sectional view showing a seal construction of an inlet pipe or an outlet pipe and a guide portion of a viscous seal.

FIG. 11 shows the details of a seal construction between the inlet pipe 28 and the outlet pipe 29, and the end of the guide portion 32 of the viscous seal 16, both of which are sealed by a bite pipe joint 39.

Figure 12:
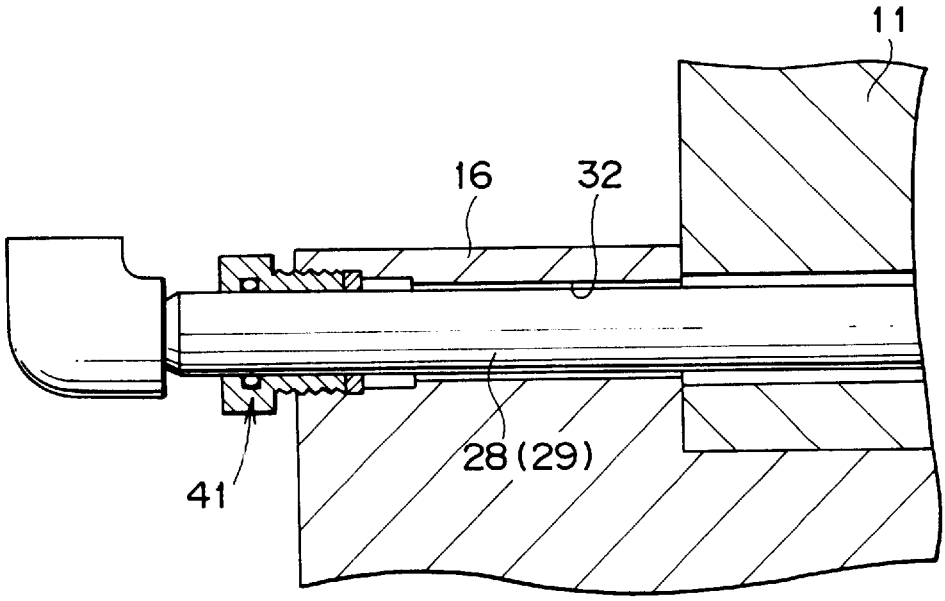
FIG. 12 is an enlarged sectional view showing a further seal construction of an inlet pipe or an outlet pipe and a guide portion of a viscous seal.

In FIG. 12, an O-ring 41 is used in place of the bite pipe joint to carry out sealing.

Preferably, Ag plating is applied to the inner circumferential surface of the bearing 6. By applying plating as described, even if the peripheral speed of the rotor shaft part 8 is 0.5 m/s or more, the long service life of 10~20 years can be achieved together with the cooling construction of the bearing 6.

The present invention is not limited to those shown in the aforementioned embodiments, but for example, the invention is not limited to one for carrying molten resins, and further, the guiding direction of the inlet pipe or the outlet pipe is not particularly limited. Further, as the temperature adjusting media, only the cooling medium will suffice.

What is claimed is:

1. A gear pump comprising:

a body;

a bearing;

a pair of gear rotors, said gear rotors being supported on said body through said bearing;

a cover for preventing said bearing from being slipped out in the axial direction of said bearing, said cover being secured to said body;

a temperature adjusting medium passage formed in said bearing;

an inlet pipe provided on the axial outer end of said bearing, said inlet pipe being communicated with said temperature adjusting medium passage;

an outlet pipe provided on the axial outer end of said bearing, said outlet pipe being communicated with said temperature adjusting medium passage; and an intermediate plate interposed between the axial outer end of said bearing and said cover, said intermediate plate being formed with a hole for inserting said input pipe and said outlet pipe therein, wherein said cover is provided with a guide portion having said inlet pipe and said outlet pipe loosely fitted therein to guide them to outside.

2. The gear pump according to claim 1, wherein said bearing is held on said body in a non-secured state.

3. The gear pump according to claim 1, wherein the pump is for carrying molten resins.

4. The gear pump according to claim 1, wherein a part of the material to be carried is supplied as a lubricant between said bearing and said gear rotor.

5. The gear pump according to claim 1, wherein said guide portion is depressed along the diametrical direction of said rotor on the intermediate plate side end of said cover.

6. The gear pump according to claim 1, wherein both end surfaces of said intermediate plate comprise seal surfaces.

7. The gear pump according to claim 1, wherein both end surfaces of said intermediate plate are in contact with said bearing and said cover through a seal member.

8. The gear pump according to claim 1, wherein said inlet pipe and said outlet pipe are mounted on said bearing through water-tight means.

9. The gear pump according to claim 1, wherein said intermediate plate is integrated with a thrust plate provided in order to locate said bearing in an axial direction, said thrust plate being provided separately from said bearing.

10. The gear pump according to claim 1, further comprising:

viscous seal for preventing leakage of liquid form said gear rotor, said viscous seal being provided at an axial outer position of said bearing, and fastening means provided on said viscous seal, said fastening mean raising mounting surface pressure of said intermediate plate and said cover.

11. A gear pump comprising:

a body;

a bearing;

a pair of gear rotors, said gear rotors being supported on said body through said bearing;

a cover for preventing said bearing from being slipped out in the axial direction of said bearing, said cover being secured to said body; a temperature adjusting medium passage formed in said bearing;

an inlet pipe provided on the axial outer end of said bearing, said inlet pipe being communicated with said temperature adjusting medium passage, at least a part of said inlet pipe being formed from a flexible member; and an outlet pipe provided on the axial outer end of said bearing, said outlet pipe being communicated with said temperature adjusting medium passage, at least a part of said outlet pipe being formed from a flexible member, wherein said cover is provided with a guide portion having said inlet pipe and said outlet pipe loosely fitted therein to guide them to outside.

12. The gear pump according to claim 11, wherein said guide portion is provided in parallel with the shaft center of the gear rotor, and the diameter of the guide portion is larger than that of the inlet pipe and that of the outlet pipe.

13. The gear pump according to claim 11, wherein said bearing is held on said body in a non-secured state.

14. The gear pump according to claim 11, wherein the pump is for carrying molten resins.

15. The gear pump according to claim 11, wherein a part of the material to be carried is supplied as lubricant between said bearing and said gear rotor.

16. The gear pump according to claim 11, wherein said guide portion is depressed along the diametrical direction of said rotor on the intermediate plate side end of said cover.

17. The gear pump according to claim 11, further comprising an intermediate plate interposed between the axial outer end of said bearing and said cover, said intermediate plate being formed with a hole for inserting said inlet pipe and said outlet pipe inserted therein.

18. The gear pump according to claim 17, further comprising:

a viscous seal for preventing leakage of liquid form said gear rotor, said viscous seal being provided at an axial outer position of said bearing; and fastening means provided on said viscous seal, said fastening means raising mounting surface pressure of said intermediate plate and said cover.

* * * * *